United States Patent [19]

Hoffman, Jr.

[11] Patent Number: 4,869,529

[45] Date of Patent: Sep. 26, 1989

[54] AUTOMATIC BOOKMARK AND PAGE HOLDING DEVICE

[76] Inventor: Henry R. Hoffman, Jr., 4201 Spring Valley Rd., Suite 333, Dallas, Tex. 75244

[21] Appl. No.: 235,106

[22] Filed: Aug. 23, 1988

Related U.S. Application Data

[63] Continuation-in-part of Ser. No. 934,024, Nov. 24, 1986, Pat. No. 4,793,632.

[51] Int. Cl.[4] ..... B42D 9/00; B42D 9/06; B42D 9/02; E05D 15/00

[52] U.S. Cl. ..... 281/42; 281/45; 16/363

[58] Field of Search ..... 281/42, 45, 46, 144; 116/238, 233, 234, 235, 236, 237, 238, 239, 240; 16/363, 362, 361; DIG. 19/34, 64; 24/81, 67.5, 363

[56] References Cited

U.S. PATENT DOCUMENTS

| | | | |
|---|---|---|---|
| 284,404 | 9/1883 | Foote . | |
| 461,341 | 10/1891 | Johnson . | |
| 512,747 | 1/1894 | Platt . | |
| 563,381 | 7/1896 | Judd . | |
| 704,410 | 7/1902 | Weaver . | |
| 840,475 | 1/1907 | Conter . | |
| 854,873 | 5/1907 | Conter . | |
| 875,502 | 12/1907 | Chadwick . | |
| 898,669 | 9/1908 | Moore et al. . | |
| 1,150,678 | 8/1915 | Heazlewood . | |
| 1,346,856 | 7/1920 | Sprague . | |
| 1,438,299 | 12/1922 | Conter . | |
| 1,469,163 | 9/1923 | Mallina . | |
| 1,540,777 | 6/1925 | Hellerman . | |
| 1,646,291 | 10/1927 | Horacek . | |
| 1,676,644 | 7/1928 | Faulken . | |
| 1,700,846 | 2/1929 | Klein . | |
| 1,712,137 | 5/1929 | Curti | 281/42 |
| 1,847,184 | 3/1932 | Hellerman . | |
| 1,862,573 | 6/1932 | Grosz . | |
| 1,937,442 | 11/1933 | Scognamillo | 281/42 |
| 2,387,607 | 10/1945 | Pascoo | 116/119 |
| 2,435,886 | 2/1948 | Hayes | 116/238 |
| 2,436,609 | 2/1948 | Safier | 116/119 |
| 2,442,708 | 6/1948 | Pascoo | 116/119 |
| 2,449,211 | 9/1948 | Forsyth | 116/119 |
| 2,610,074 | 9/1952 | Meyers | 281/42 |
| 2,778,331 | 1/1957 | Bonilla | 116/119 |
| 2,837,802 | 6/1958 | Genco | 24/66 |
| 3,016,036 | 1/1962 | Jorgensen | 281/42 |
| 3,158,131 | 11/1964 | Salayka | 116/119 |
| 3,381,654 | 5/1968 | Hupp et al. | 116/237 |
| 4,285,532 | 8/1981 | Davis | 281/42 |
| 4,487,156 | 12/1984 | Frost | 116/239 |
| 4,793,632 | 12/1988 | Hoffman | 281/42 |

FOREIGN PATENT DOCUMENTS

| | | | |
|---|---|---|---|
| 658705 | 3/1938 | Fed. Rep. of Germany | 281/42 |
| 778251 | 3/1935 | France | 116/119 |
| 243533 | 1/1947 | Switzerland | 16/363 |
| 143662 | 6/1920 | United Kingdom | 16/363 |
| 406765 | 3/1934 | United Kingdom | 116/237 |

*Primary Examiner*—Frank T. Yost
*Assistant Examiner*—Paul M. Heyrana
*Attorney, Agent, or Firm*—Richards, Harris, Medlock & Andrews

[57] ABSTRACT

A bookmark and page holding device is provided for automatically holding and marking a page of a book. A spring clip attaches the bookmark to the rear cover of a book. A spring-loaded swing arm is pivotally attached to the spring clip at one end and has a page holder plate pivotally attached to the other end. In one embodiment, the swing arm is lengthwise adjustable to accommodate various sizes of books. As the book page is turned, the page holder plate pivots up and away from the page, allowing the page holder plate to return to the next page under the action of the spring-loaded swing arm. In a second embodiment, the page holder plate can be removed from the device and replaced. In a preferred embodiment, the page holder has an arcuate, inwardly curving edge for engaging the edge of the turned page to facilitate its use with lightweight paper. The page holder plate marks the last page being read when the book is closed as well as when opened. The page holder plate of another preferred embodiment is releasably attached to the bookmark such that various plates can be conveniently used with a single bookmark and page holding device.

14 Claims, 4 Drawing Sheets

FIG. 1
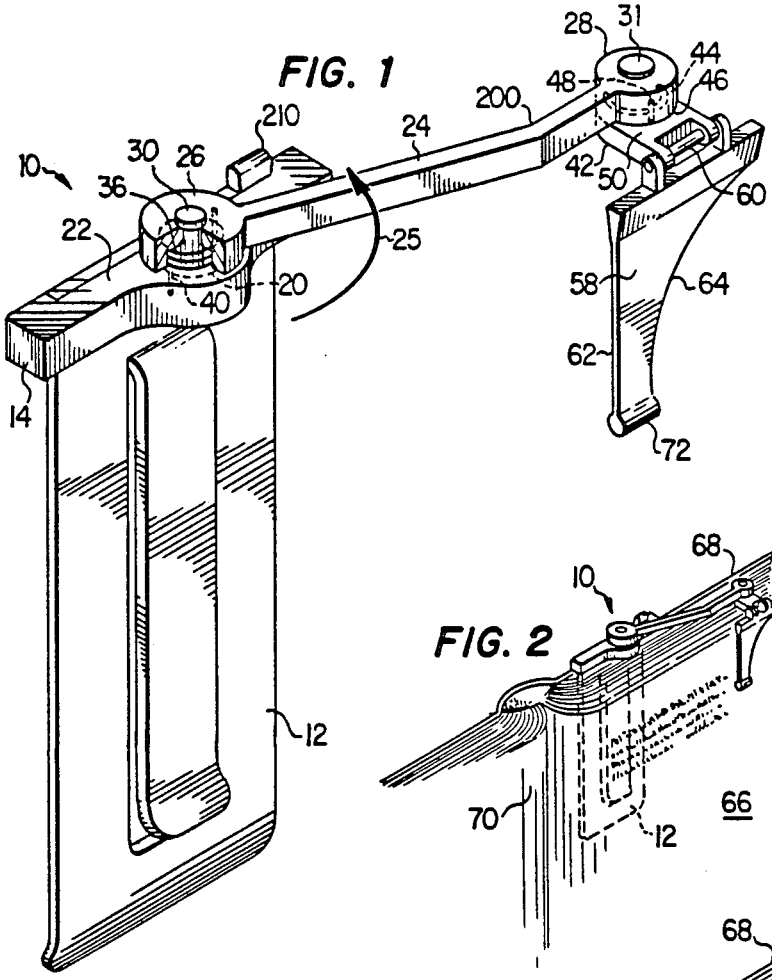
FIG. 2
FIG. 3
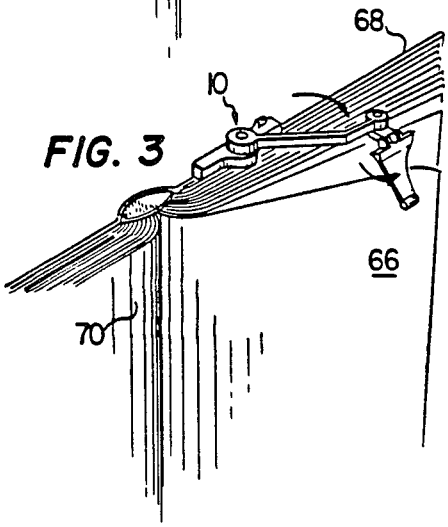

AUTOMATIC BOOKMARK AND PAGE HOLDING DEVICE

RELATED APPLICATION

This application is a continuation-in-part of copending application for U.S. Pat. Ser. No. 934,024 filed Nov. 24, 1986.

TECHNICAL FIELD

This invention relates to bookmarks and page holding devices, and in particular to an automatic bookmark and page holding device.

BACKGROUND ART

Bookmarks have typically provided a method for marking a page in a book and/or holding a book open to a particular location. Differences in the size of books and the types of materials used in construction (hardback versus paperback, thin versus thick, heavy paper versus light paper, etc.) present a problem in finding one bookmark that is suitable for use with most types of books.

Some bookmarks, such as U.S. Pat. No. 704,410, issued July 8, 1902, to C. P. Weaver, and U.S. Pat. No. 1,438,299, issued Dec. 12, 1922, to M. J. Conter, are suitable for use with a hardback book but are not usable with paperback books. Other bookmarks, such as U.S. Pat. No. 840,475, issued Jan. 8, 1907, to M. J. Conter, may be suitable for pages made from a heavyweight paper, but would be unsuitable for use with a lightweight paper. In addition, bookmarks have been made with special widening procedures to accommodate books of varying book thicknesses, such as U.S. Pat. No. 1,700,846, issued Feb. 5, 1929, to B. Klein, and U.S. Pat. No. 2,436,609, issued Aug. 16, 1946, to A. Safier. A need thus exists for a bookmark that automatically marks the page in a book as each page is turned and that is suitable for use with books of varying size and materials of construction.

SUMMARY OF THE INVENTION

The bookmark of the present invention automatically marks the page of a book upon the reader's action of turning a page and is suitable for use with books of varying thickness and with pages of varying paper weight.

The bookmark has a clip which may be used for mounting to the rear cover of a paperback or hardbound book. The clip has a spring-loaded swing arm attached to it by a yoke. In a preferred embodiment, the length of the swing arm can be mechanically adjusted to accommodate various size books. On the end of the swing arm distal from the clip is a second yoke and a spring-loaded or weighted page holder. In one particular embodiment, the page holder includes an arcuate, inwardly curving, edge for engaging the edge of a turned page. In another embodiment, the page holder can be readily removed and replaced through the use of a combination of a page holder yoke and a page holder plate in lieu of a page holder.

In use, the bookmark is clipped to the rear cover of a book. The spring-loaded swing arm is then positioned so that the spring-loaded or weighted page holder rests on the right-hand page of the open book. As each right-hand page is turned, the page holder pivots up and away from the page. After the page has been turned, the page holder pivots back down onto the next page. The spring-loaded swing arm maintains the page holder in engagement with the page and provides a means for accommodating books of various thicknesses and automatically adjusting to the varying distance between the page holder and the rear cover. When the book is closed the page holder marks the reader's place.

BRIEF DESCRIPTION OF THE DRAWINGS

For a more complete understanding of the present invention and for further advantages thereof, reference is now made to the following Description of the Preferred Embodiment taken in conjunction with the accompanying Drawings in which:

FIG. 1 is a perspective, partially exploded view of the present invention;

FIG. 2 is a perspective view of the present invention marking a page of an open book;

FIG. 3 is a perspective view of the present invention as a page of the book is turned;

DESCRIPTION OF THE PREFERRED EMBODIMENTS

Figure 4:
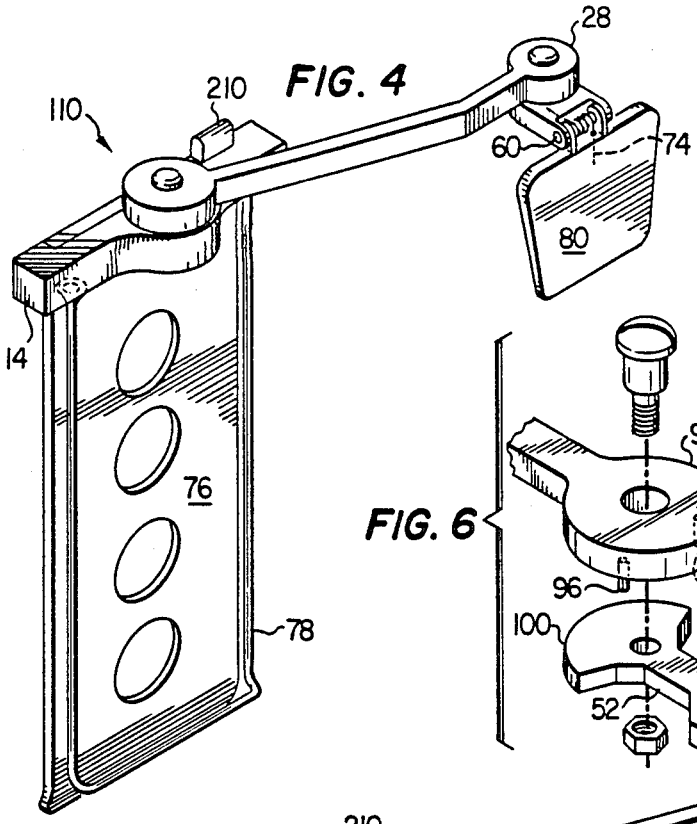
FIG. 4 is a perspective view of an alternate embodiment of the present invention.

Referring to FIG. 1, an automatic bookmark and page holding device of the present invention is generally identified by reference numeral 10. A spring clip 12 provides a means to attach automatic bookmark 10 to a rear cover 68 of a book 70 (FIG. 2). A first yoke 14 is secured to spring clip 12 by any appropriate means, such as using fasteners, adhesives, or as an integral part of a plastic molding, and the first yoke 14 has a milled or molded cavity 20 in its top surface 22.

A spring-loaded swing arm 24 has a first end 26 proximate to the yoke 14 and a second end 28 distal from the yoke 14. The first end 26 of spring-loaded swing arm 24 has a milled or molded cavity 36 in its bottom surface 38 to be aligned with the milled or molded cavity 20 in the top surface 22 of first yoke 14. A spring 40 is secured within first milled cavity 20 and within the milled cavity 36 for biasing the swing arm 24 in the direction shown by arrow 25. The spring-loaded swing arm 24 is pivotally mounted to the top surface 22 of first yoke 14 by any appropriate means, such as a pin 30, or a bolt and nut with or without washers, or a collared bolt and nut of appropriate material. The top surface 22 of first yoke 14 has a raised stop 210 which serves to limit the rotation of the spring-loaded swing arm 24 in the direction shown by arrow 25. Swing arm 24 may have a bend 200 to allow full access of the page holder.

Figure 7:
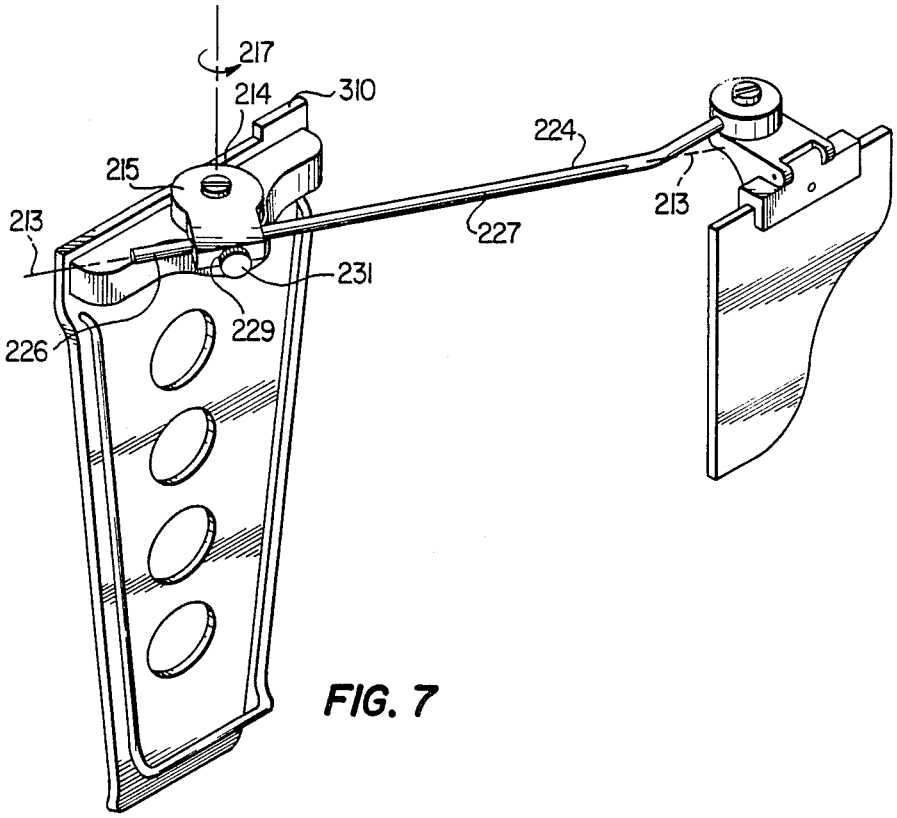
FIG. 7 is a perspective view of a preferred embodiment of the swing arm of the present invention.

In a preferred embodiment, the spring-loaded swing arm 24 is slidably adjustable along its longitudinal axis 213. FIG. 7 shows first yoke 214 having a first rotatable yoke portion 215 rotatably mounted thereon. The rotation of first rotatable yoke portion 215 relative to first yoke 214 may be spring-biased in direction 217 by any known means for biasing and limited by raised stop 310. A channel 219 is integrally formed in first rotatable yoke portion 215 to slidably receive first end 226 of swing arm 224. Slot 227 is formed along the length of swing arm 224. Threaded aperture 229 is formed in first rotatable yoke portion 215 to receive screw 231. Screw 231 engages slot 227 of swing arm 224 to secure swing arm 224 relative to first rotatable yoke portion 215. Screw 231 also prevents swing arm 224 from rotating about its longitudinal axis 213 through its engagement of slot 227. In order to adjust the functional length of swing arm 224, screw 231 is loosened and swing arm 224 is slid through channel 219 to its desired length. Screw 231 is then tightened to secure swing arm 224 relative to first rotatable yoke portion 215.

As best depicted in FIG. 1, a second yoke 42 is pivotally mounted to the second end 28 of spring-loaded swing arm 24 by any appropriate means, such as a pin 31, or a bolt and nut with or without washers, or a collared bolt and nut of appropriate material. The second end 28 has a groove 44 cut into its underside 46. The second yoke 42 has a pin 48 extending from its top side 50 and positioned so as to travel within groove 44, thus providing a means to allow yoke 42 to rotate a certain distance about pin 31.

Figure 9:
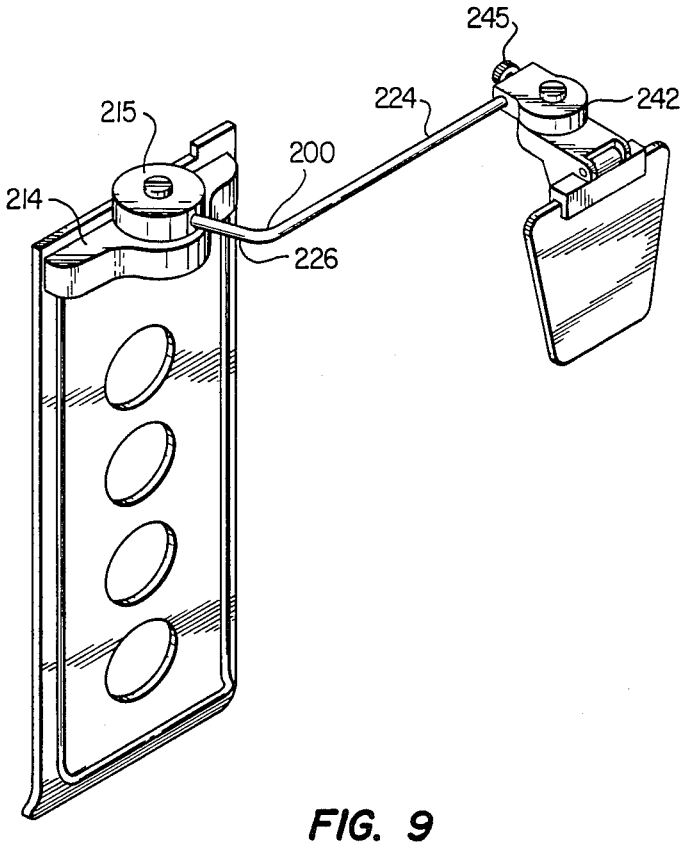
FIG. 9 is a perspective view of a second preferred embodiment of the swing arm of the present invention.

In a second preferred embodiment depicted in FIG. 9, swing arm 224 is affixed at its first end 226 to first rotatable yoke portion 215 which, in turn, is rotatably mounted on first yoke 214. The rotation of first rotatable yoke portion 215 relative to first yoke 214 may be spring-biased in accordance with the preferred embodiment depicted in FIG. 7. A bend 200 is positioned at first end 216 of swing arm 224 in order to maximize the efficacy of this embodiment. Second yoke 242 is slidably mounted on swing arm 224. A threaded aperture 243 is formed in second yoke 242 to receive screw 245. In this embodiment, the functional length of swing arm 224 can be adjusted by loosening screw 245 and sliding second yoke 242 along swing arm 224 to the desired position. Screw 245 is then tightened to secure second yoke 242 relative to swing arm 224.

A page holder plate 58 is attached to a spring bar 60 journaled for rotation within the second yoke 42 to allow the plate 58 to pivot on the spring bar 60. The page holder plate 58 has a straight side 62 and an arcuate, inwardly curving, side 64 proximate the right hand edge of a page. The arcuate side 64 guides a page 66 as it is being turned, as seen at FIG. 3, facilitating the use of the bookmark 10 with lightweight paper pages. A weight 72 or a coiled spring member 74 (FIGS. 4 and 5) may be attached to the page holder plate 58 to help mark and hold page 66 as seen in FIG. 2. The bookmark 10 may be constructed of any suitable material, as molded plastic or metal parts.

Figure 8:
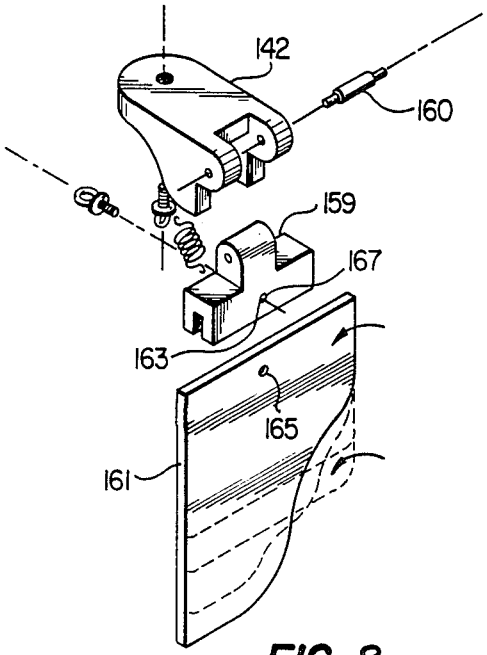
FIG. 8 is a perspective, partially exploded view of a preferred embodiment of the page holder yoke and the page holder plate of the present invention.

In an alternative embodiment depicted in FIG. 8, a page holder yoke 159 is pivotally mounted on spring bar 160 journaled for rotation within second yoke 142. Page holder yoke 159 is substantially U-shaped to receive page holder plate 161. An aperture 163 is formed through page holder yoke 159 and a corresponding aperture 165 is formed through page holder plate 161. A releasable pin means 167 passes through apertures 163, 165 to releasably secure page holder plate 161 to page holder yoke 159. In this alternative embodiment, the page holder plate can be readily removed from bookmark 10 and replaced. This is desirable in that page holder plates of various sizes and shapes can be interchangeably used with a single automatic bookmark. Interchangeability of page holder plates is important because a page holder plate used with a hard bound book would preferably be structurally distinct from the page holder plate used for a paperback book due to the differing structural characteristics of the books.

Figure 5:
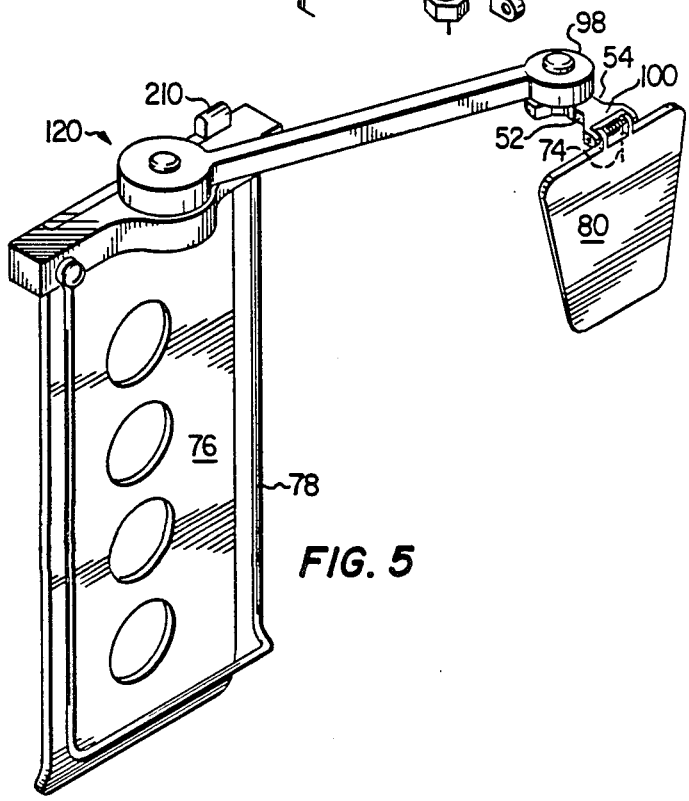
FIG. 5 is a perspective view of yet another embodiment of the present invention.

Referring to FIGS. 4 and 5, alternate embodiments of the present invention are generally identified by the reference numerals 110 and 120. It is to be understood, that the bookmarks 110, 120 are constructed in a like manner to bookmark 10, except as shown otherwise in FIGS. 4 and 5 and described herein.

The bookmarks 110, 120 have a plate 76 and a U-shaped spring wire 78 attached thereto as an alternate means of securing the bookmark to the rear cover of a book.

Figure 6:
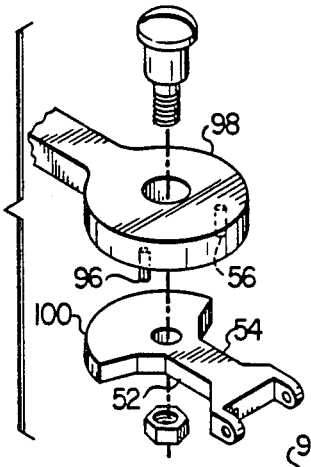
FIG. 6 is a perspective, partially exploded view of FIG. 5.

The bookmark 110 has a generally rectangular page holder 80 and includes a coiled spring member 74 positioned about the bar 60 to bias page holder 80 toward the right hand page of a book. Referring to FIG. 5, swing arm 24 has a second end 98. Second end 98 has a planar surface. Second yoke 100 has oppositely facing notched portions 52 and 54. Projecting out from the planar surface of second end 98 so as to coincide with notched portions 52 and 54 are first pin 56 and second pin 96. Referring to FIG. 6, it can be seen that the range of pivotal motion of second yoke 100 is limited on one extreme limit where first pin 56 contacts notched portion 54 and on the other extreme limit where second pin 96 contacts notched portion 52.

Although the present invention has been described with respect to specific preferred embodiments thereof, various changes and modifications may be suggested to one skilled in the art and it is intended that the present invention encompass such changes and modifications as fall within the scope of the appended claims.

What is claimed is:

1. A bookmark and page holding device comprising:

a means for attachment to a book;

a first rotatable yoke portion rotatably mounted on said means for attachment, said first rotatable yoke portion being pivotable about a first axis, and said first rotatable yoke portion having a channel formed therethrough;

a swing arm having a first end slidably mounted through said channel of said first rotatable yoke portion, said swing arm also having a second end distal to said first end;

means for spring-loading said first rotatable yoke portion relative to said means for attachment;

a second yoke having a first end pivotally connected to said second end of said swing arm, said second yoke being pivotable about a second axis, said second axis lying parallel to and co-planar with said first axis, said second yoke having a second end distal to said first end of said second yoke, and said second yoke being limited in its pivotable movement relative to said second end of said swing arm by a rotation limiting means; and a page holder plate pivotally connected to said second end of said second yoke, said page holder plate being pivotable about a third axis, said third axis lying perpendicular to said second axis and lying in a plane parallel to said plane defined by the page types of said book, wherein said rotation limiting means comprises a pin extending from a surface of said second yoke adjacent said swing arm and a groove formed in a side of said second end of said swing arm adjacent said yoke for receiving said pin, whereby rotational movement of said page holder in the plane of said swing arm is limited by the length of said groove in which said pin travels.

2. The bookmark and page holding device of claim 1, wherein said means for attachment to a book is a spring clip.

3. The bookmark and page holding device of claim 2, wherein said spring clip is a single piece of molded plastic.

4. The bookmark and page holding device of claim 2, wherein said spring clip comprises:

a backplate; and a spring wire attached to said back plate, whereby a book cover is clamped between said back plate and said spring wire.

5. The bookmark and page holding device of claim 1, wherein said first rotatable yoke portion is limited in its pivotally biased movement by a stop on said means for attachment to a book.

6. The bookmark and page holding device of claim 1, wherein said page holder plate comprises:

a first edge proximal to said means for attachment, said first edge parallel to said second axis; and a second edge distal to said means for attaching, said second edge having an arcuate surface curved inwardly toward said first edge.

7. The bookmark and page holding device of claim 1, said device further comprising:

a means for releasably securing said swing arm to said first rotatable yoke portion.

8. The bookmark and page holding device of claim 7, wherein said means for releasably securing said swing arm relative to said first rotatable yoke portion comprises:

said swing harm having a slot formed along its length;

said first rotatable yoke portion having a threaded aperture formed therethrough, said threaded aperture of said first rotatable yoke portion lying perpendicular to and terminating at said channel through said first rotatable yoke portion; and a screw threadably mounted through said threaded aperture of said first rotatable yoke portion, whereby said screw can be threadably tightened to engage said slot along said swing arm to releasably secure said swing arm relative to said first rotatable yoke portion.

9. The bookmark and page holding device of claim 1, wherein a weight is disposed on said page holder plate at an end of said page holder plate distal to said yoke.

10. The bookmark and page holding device of claim 1, wherein said page holding plate is spring-loaded relative to said yoke.

11. A bookmark and page holding device comprising:

a means for attachment to a book;

a swing arm having a first end pivotally connected to said means for attachment, said first end being pivotable about a first axis, said swing arm also having a second end distal to said first end;

means for spring-loading said swing arm relative to said means for attachment;

a yoke slidably mounted on said swing arm;

a second yoke having a first end pivotally connected to said yoke, said second yoke being pivotable about a second axis, said second axis lying parallel to and co-planar with said first axis, said second yoke also having a second end distal to said first end of said second yoke; and a page holder plate pivotally connected to said second end of said second yoke, said page holder plate being pivotable about a third axis lying perpendicular to said second axis and lying in a plane parallel to the plane defined by the page tops of said book.

12. A bookmark and page holding device comprising:

a means for attachment to a book;

a swing arm having a first end pivotally connected to said means for attachment, said swing arm being pivotable about a first axis, said swing arm also having a second end distal to said first end;

means for spring-loading said swing arm relative to said means for attachment;

a yoke having a first end pivotally connected to said second end of said swing ar, said yoke being pivotable about a second axis, said second axis lying parallel to and co-planar with said first axis, said yoke also having a second end distal to said first end of said yoke, and said yoke being limited in its pivotable movement relative to said second end of said swing arm by a rotation limiting means;

a page holder yoke pivotally mounted to said second end of said yoke, said page holder yoke being pivotable about a third axis lying perpendicular to said second axis and lying in a plane parallel to the plane defined by the page tops of said book;

a page holder plate; and a means for releasably retaining said page holder plate on said page holder yoke.

13. The bookmark and page holding device of claim 12, wherein said means for releasably retaining said page holder plate on said page holder yoke comprises;

said page holder yoke having an aperture formed therethrough;

said page holder plate having an aperture formed therethrough; and a releasable pin constructed to pass through said aperture through said page holder yoke and said aperture through said page holder plate, whereby said page holder plate is releasably retained relative to said lower page holder yoke by said releasable pin.

14. A bookmark and page holding device comprising:

a means for attachment to a book;

a first rotatable yoke portion rotatably mounted on said means for attachment said first rotatable yoke portion being pivotable about a first axis, said first rotatable yoke portion having a channel formed therethrough;

a swing arm having a first end slidably mounted through said channel through said first rotatable yoke portion, said swing arm having a second end distal said first end;

means for spring-loading said first rotatable yoke portion relative to said means for attachment;

a second yoke rotatably mounted on said second end of said swing arm, said second yoke being pivotable about a second axis, said second axis lying parallel to and co-planar with said first axis;

a lower page holder yoke rotatably mounted on said second yoke, said lower page holder yoke being pivotable about a third axis, said third axis lying perpendicular to said second axis and parallel to the plane defined by the page tops of said book;

a page holder plate; and a means for releasably retaining said page holder plate on said lower page holder yoke.

* * * * *